US006618953B2

(12) United States Patent
Izumi

(10) Patent No.: US 6,618,953 B2
(45) Date of Patent: Sep. 16, 2003

(54) LEVELING ASSEMBLY FOR SETTING A VERTICAL PROP

(76) Inventor: Shuhei Izumi, 30-1 Ippongi, Toyama-shi, Toyama 930-0904 (JP)

( * ) Notice: Subject to any disclaimer, the term of this patent is extended or adjusted under 35 U.S.C. 154(b) by 0 days.

(21) Appl. No.: 10/044,415

(22) Filed: Jan. 9, 2002

(65) Prior Publication Data

US 2003/0126751 A1 Jul. 10, 2003

(51) Int. Cl.[7] ..... G01C 9/00

(52) U.S. Cl. ..... 33/521; 248/542; 248/514; 33/534

(58) Field of Search ..... 33/521, 530, 333, 33/343, 354, 374, 375, 385, 281, 282, 285, 534, 1 N; 248/511, 514, 515, 542, 543

(56) References Cited

U.S. PATENT DOCUMENTS

| | | | | | |
|---|---|---|---|---|---|
| 684,451 | A | * | 10/1901 | Mowry | 248/514 |
| 2,373,641 | A | * | 4/1945 | Ackerson | 33/385 |
| 2,636,280 | A | * | 4/1953 | Drake | 33/530 |
| 2,775,221 | A | * | 12/1956 | Olson | 248/511 |
| 3,162,407 | A | * | 12/1964 | Yax | 248/514 |
| 3,305,990 | A | * | 2/1967 | Hageby | 248/511 |
| 5,588,630 | A | * | 12/1996 | Chen-Chao | 248/514 |
| 5,594,669 | A | * | 1/1997 | Heger | 33/343 |
| 5,878,502 | A | * | 3/1999 | Donahue, Jr. | 33/374 |
| 6,029,359 | A | * | 2/2000 | Szumer | 33/373 |

* cited by examiner

*Primary Examiner*—G. Bradley Bennett
(74) *Attorney, Agent, or Firm*—Leighton K. Chong; Ostrager Chong & Flaherty (HI)

(57) ABSTRACT

A leveling assembly for setting a vertical prop is comprised of an inclined surface setting member 20 and a horizontal surface forming member 30. The horizontal surface forming member 30 has a horizontal surface 32 to be adjusted to a horizontal position and an opposite first adjusting surface 31 that is not parallel to horizontal surface 32. The inclined surface setting member 20 has a setting surface 21 facing a slope inclined surface 11 and an opposite second adjusting surface 22 facing the first adjusting surface 31 which is not parallel to the setting surface 21. The horizontal surface forming member 30 and the inclined surface setting member 20 are placed on top or each other, and the horizontal surface 32 is adjusted to the horizontal position relative to the slope inclined surface 11 by rotating the members relative to each other to change the degree angle between the horizontal surface 32 and the setting surface 21.

6 Claims, 4 Drawing Sheets

LEVELING ASSEMBLY FOR SETTING A VERTICAL PROP

BACKGROUND OF THE INVENTION

1. The Field of the Invention

The present invention relates to a leveling assembly for setting a pole such as a vertical prop which is to be set vertically and fixed on a slope inclined surface. The slope may be indoor or outdoor.

2. Description of Related Art

A policy to make access to places in the city and homes open to handicap persons and elder persons referred to as "barrier free" has been pursued in recent years. Barrier free means to achieve structures indoor or outdoor without steps and differences in levels and enable coming and going with wheelchairs freely.

Under the barrier free concept, slopes are used at places having differences in levels instead of or in addition to stairs. Further, generally handrails are provided along slopes.

The handrail set along the slope is fixed to handrail poles or props set vertically at plural points regardless of the inclination degree of the slope. Dais or platforms set between the bottom of the handrail poles and the slope are prepared in standards of many kinds depending on the inclination of the slope.

However, preparing a platform (dais) which matches the inclination of each slope imposes a big burden on a parts supplier.

And, in case of slope that gradually changes in inclination, preparing plural kinds of dais imposes a big burden on worker, too.

Further, the inclination of a slope can be calculated in the designing step, but often a small difference is encountered between the slope at the designing step and the slope when made actually. Adjusting such difference is difficult to do by using a preformed platform at the work site, i.e., the adjusting is done by an artisan technique of the worker or the work is done by the worker ignoring the difference.

In the example mentioned above, setting handrail poles on a slope is explained as one example; however, setting or burying a vertical prop on an inclined surface causes the same problem.

Accordingly, an object of the present invention is to lighten the burden on a parts supplier and at the same time lighten the burden on the worker so that installation does not depend on the worker's skill when setting a vertical prop on the slope inclined surface.

Another object of the present invention is to supply a leveling assembly for setting a vertical prop which lightens the burden on a worker to do adjusting work.

Further, another object of the present invention is to supply a leveling assembly for setting a vertical prop which is not subject to settling (slackness), etc. after the installation work.

With respect to the present application, the present applicant conducted a prior art search using the patent reference database named "Cyber Patent Desk" supplied by Nomura Sogo Kenkyujo Inc.

The keyword reference for retrieval from patent claims was: a formula "(spirit level) and (prop or pole)" and 36 cases were extracted. Patent Unexamined Publications such as No. Hei 9-280865 and No. Hei 11-63995 were found and examined, but the present applicant recognizes that they are not the same art as the present application.

SUMMARY OF THE INVENTION

To solve the mentioned problems, the present invention provides a leveling assembly for setting a vertical prop comprised of an inclined surface setting member set on a slope inclined surface and a horizontal surface forming member for fixing the vertical prop to be set vertically, wherein said horizontal surface forming member has an upper horizontal surface to be set horizontally and a lower first adjusting surface formed by a surface not parallel to said horizontal surface, said inclined surface setting member has a lower setting surface set on the slope inclined surface and an upper second adjusting surface formed by a surface not parallel to said setting surface, and, said horizontal surface forming member and said inclined surface setting member are placed one on top of the other with said first adjusting surface and said second adjusting surface facing in contact with each other, and, said horizontal surface is made horizontal relative to the slope inclined surface by rotating the members relative to one another and changing a degree angle between said horizontal surface and said setting surface.

In this case, the "slope inclined surface" may be indoor or outdoor. Therefore, when the slope inclined surface is set inside a house, a leveling assembly for setting a vertical prop of the present invention is referred to as "zagane or metal washer" as parts for the house, and when the slope inclined surface is set outside a house, a leveling assembly for setting a vertical prop of the present invention is referred to as a "dais" as parts for civil engineering.

"Vertical prop" is a member to be stood and fixed vertically relative to the lengthwise direction of the installed member, for example, a handrail pole to support a handrail. The vertical prop has a structure of being vertical to its lengthwise direction when fixed to the horizontal surface of the horizontal surface forming member.

The setting surface of the inclined surface setting member is set in contact with the slope inclined surface and then the inclined surface setting member is fixed thereto. Next, the horizontal surface forming member is placed with its first adjusting surface on top of the second adjusting surface of the inclined surface setting member. And, when the first adjusting surface is rotated relatively to the second adjusting surface, a degree angle between the horizontal surface and the setting surface can be changed so that the horizontal surface can be adjusted to be horizontal. Moreover, the inclined surface setting member may be rotated properly and adjusted to be appropriate in matching degree.

When the horizontal surface is adjusted to be horizontal, the horizontal surface forming member and the inclined surface setting member are fixed together, and the vertical prop is fixed to the horizontal surface.

By providing a leveling assembly for setting a vertical prop of the present invention, one part may be used within the range of angles of the horizontal surface to the slope inclined surface, and the burden on the parts supplier may be lightened.

In particular, a leveling assembly for setting a vertical prop is characterized in that; said first adjusting surface and said second adjusting surface are formed by cutting a column member at an oblique angle into two members at their cutting surfaces, and, a graded index for indicating the relative rotational position of the members to each other is marked on a peripheral surface of said inclined surface setting member and on a peripheral surface of said horizontal surface forming member.

By forming the graded index for indicating the relative rotational position of the members to each other, the adjusting work of making the horizontal surface horizontal by rotating the first adjusting surface relative to the second adjusting surface is easily done.

As a further feature, a leveling assembly for setting a vertical prop is characterized in that a spirit level for confirming the horizontal position is provided on the horizontal surface of the horizontal surface forming member.

The spirit level is provided so adjusting the horizontal surface to be horizontal becomes extremely easy when the second adjusting surface and the first adjusting surface are relatively rotated and the degree angle between the horizontal surface and the setting surface is changed. Accordingly, the burden on the worker is lightened and the work quality can be assured without depending on the worker's skill is possible.

As a further feature, a leveling assembly for setting a vertical prop is characterized in that a base cover is provided around said inclined surface setting member and said horizontal surface forming member to hide them after installation.

By covering the inclined surface setting member and the horizontal surface forming member with the base cover to hide them, injuries to the feet due to hitting the inclined surface setting member and/or the horizontal surface forming member are prevented and at the same time, the appearance is enhanced because the structure members such as bolts are hidden.

Further detailed explanation of the invention based on drawings of certain embodiments of a leveling assembly for setting a vertical prop is as follows.

BEST MODE FOR CARRYING OUT THE INVENTION

Figure 1:
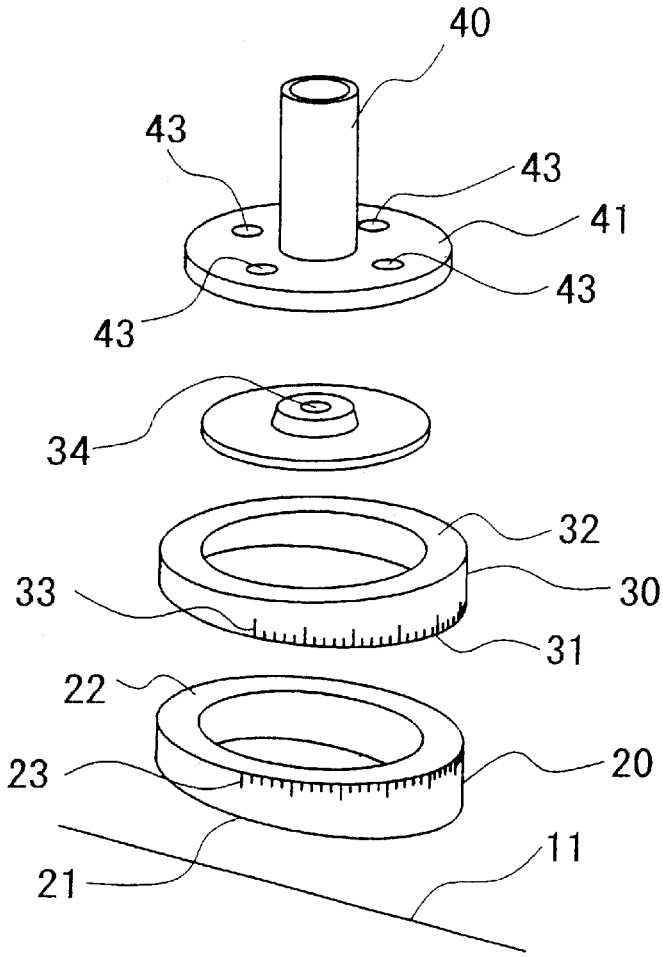
FIG. 1A is an exploded perspective view.
FIG. 1B is a perspective view of a first embodiment of a leveling assembly for setting a vertical prop according to the present invention.
Figure 1:
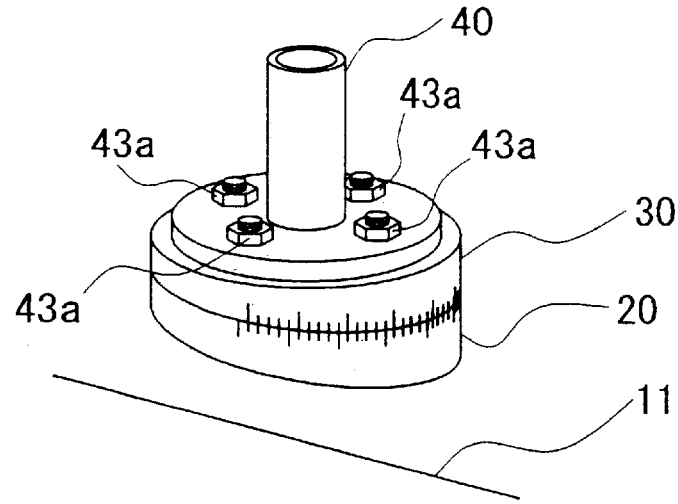

FIG. 1A is an exploded perspective view, and FIG. 1B is an exploded perspective view of a first embodiment of a leveling assembly for setting a vertical prop according to the present invention.

The first embodiment of the present invention used as a platform or dais on a slope for fixing a handrail pole 40 vertically comprises an inclined surface setting member 20 which is set on a slope inclined surface 11 and a horizontal surface forming member 30 supplied as a separate part from the inclined surface setting member 20. The inclined surface setting member 20 and the horizontal surface forming member 30 have a structure comprised of the two members being formed by cutting a column member at an oblique angle not a right angle to its lengthwise direction as shown in FIG. 1A.

As shown in FIG. 1A, the first adjusting surface 31 is the opposite surface of the horizontal surface adjusting member to a horizontal surface 32 on which the handrail pole 40 is placed and it is not parallel to the horizontal surface 32. On the other hand, the second adjusting surface 22 of the inclined surface setting member 20 is the opposite surface from a setting surface 21 facing the slope inclined surface 11 to which the inclined surface setting member 20 is fixed. Further, in the horizontal surface forming member 30, a spirit level 34 is provided on the horizontal surface 32 for guiding and easily confirming the horizontal position of the horizontal surface 32.

Figure 2:
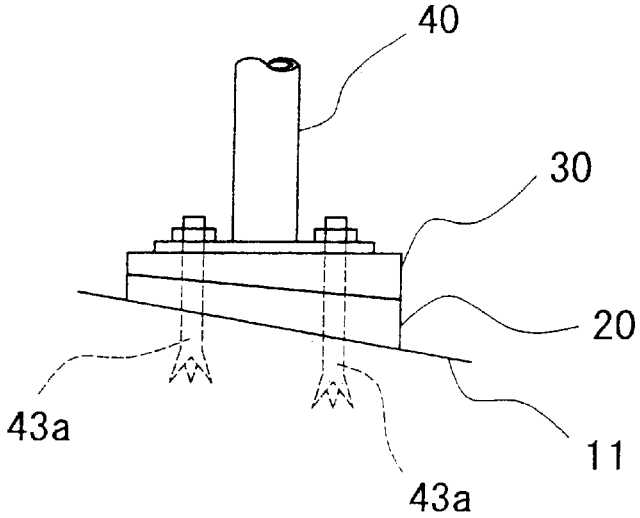
FIG. 2 is a side view of the embodiment shown in FIG. 1.

In this case, the second adjusting surface 22 and the first adjusting surface 31 are two surfaces formed by cutting a column member at an oblique angle not a right angle to its lengthwise direction, so rotating the first adjusting surface 31 to the second adjusting surface 22 is possible while they are in contact with each other closely. When the first adjusting surface 31 is rotated relative to the second adjusting surface 22, the degree angle between the horizontal surface 32 and the setting surface 21 can be changed. And adjusting the horizontal surface 32 to be horizontal while watching the spirit level 34 makes it possible to easily set the slope fixing handrail pole 40 vertically. When the horizontal surface 32 becomes horizontal, the horizontal surface forming member 30 is fixed to the inclined surface setting member 20. As shown in FIG. 2, the handrail pole 40 is placed on the horizontal surface 32, and fixed by fixing members 43*a* such as bolts using holes 43 opened at a flange part 41. Alternatively, the horizontal surface forming member 30 may be temporarily fixed and adjusting by properly rotating the inclined surface setting member 20 to make the second adjusting surface 22 and the first adjusting surface 31 have an appropriate matching degree.

As another feature, graded indices 23, 33 for indicating the relative rotational position of the members to each other are formed on a peripheral surface of the inclined surface setting member 20 and on a peripheral surface of the horizontal surface forming member 30. Therefore, the work of adjusting their relative position by rotating the first adjusting surface 31 relative to the second adjusting surface 22 and making the horizontal surface 32 horizontal is easily done.

Figure 3:
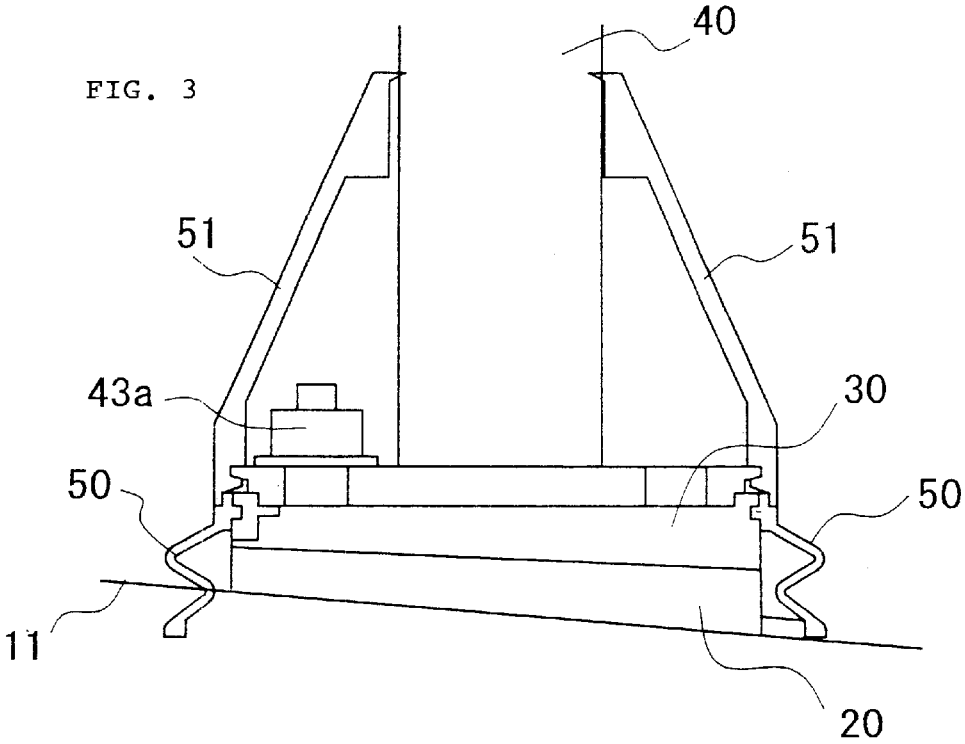
FIG. 3 is a cross sectional view showing a base cover.

Further, as shown in FIG. 3, a base cover 50 is covered around the inclined surface setting member 20 and the horizontal surface forming member 30. In the present embodiment, the base cover 50 is formed from elastic member for example, rubber, synthetic resin, etc. and at the same time formed with bellows. And, a part of base cover 50 is fixed to a protecting cone member 51 covering a lower part of the slope fixing handrail pole 40 and the horizontal surface forming member 30.

With the dais for the slope fixing handrail pole 40 according to the present embodiment, the range of adjusting the degree angle of the horizontal surface 32 and the setting surface 21 allows one part to be supplied, and the burden of the parts supplier may be lightened.

And, the work of adjusting the horizontal surface 32 to be horizontal can be done by using the spirit level 34, and accordingly, the burden of the worker is lightened and maintaining a certain work quality without depending on the worker's skill is possible.

Figure 4:
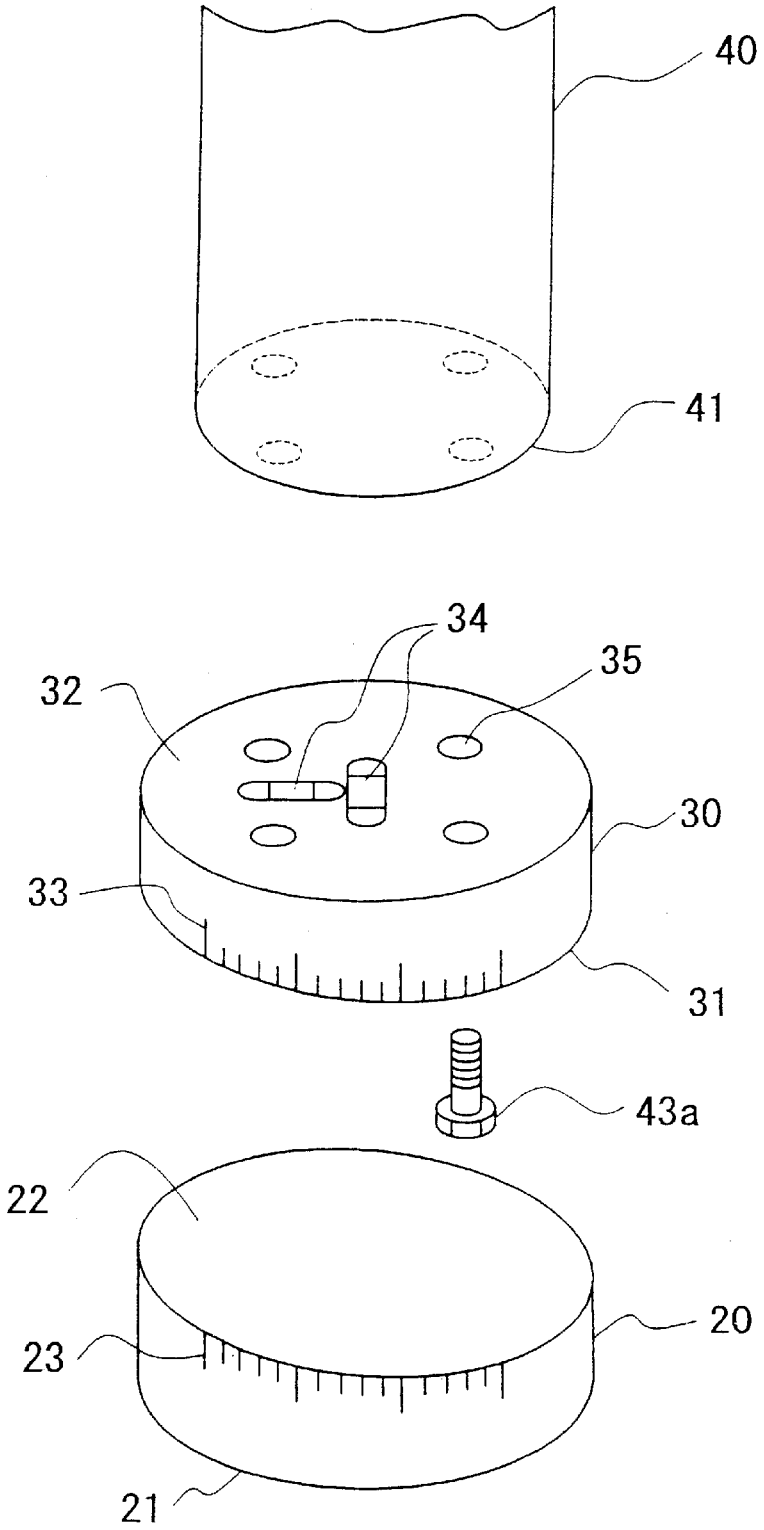
FIG. 4 is an exploded perspective view of a second embodiment of a leveling assembly according to the present invention.

FIG. 4 is an exploded perspective view of a second embodiment of a leveling assembly according to the present invention.

The second embodiment is almost the same as the first embodiment in that the inclined surface setting member 20 and the horizontal surface forming member 30 are formed by cutting a column member at an oblique angle not a right angle to its lengthwise direction, and also has the spirit level 34 and the graded indices 23, 33.

The horizontal surface forming member 30 has the first adjusting surface 31 which is not parallel to the horizontal surface 32. The inclined surface setting member 20 has the second adjusting surface 22 facing the first adjusting surface 31 and is opposite from the setting surface 21 facing the slope inclined surface 11.

And the horizontal surface 32 is adjusted to be horizontal while watching the spirit level 34, and when the horizontal surface 32 becomes horizontal, the horizontal surface forming member 30 is fixed to the inclined surface setting member 20. And the slope fixing handrail pole 40 is fixed on the horizontal surface 32, by using the fixing members 43*a* through holes (not shown) formed in the horizontal surface forming member 30. Alternatively, the horizontal surface forming member 30 may be temporarily fixed and adjusting by properly rotating the inclined surface setting member 20 to make the second adjusting surface 22 and the first adjusting surface 31 have an appropriate matching degree. Of course, the base cover 50 may be covered around the inclined surface setting member 20 and the horizontal forming member 30.

Figure 5:
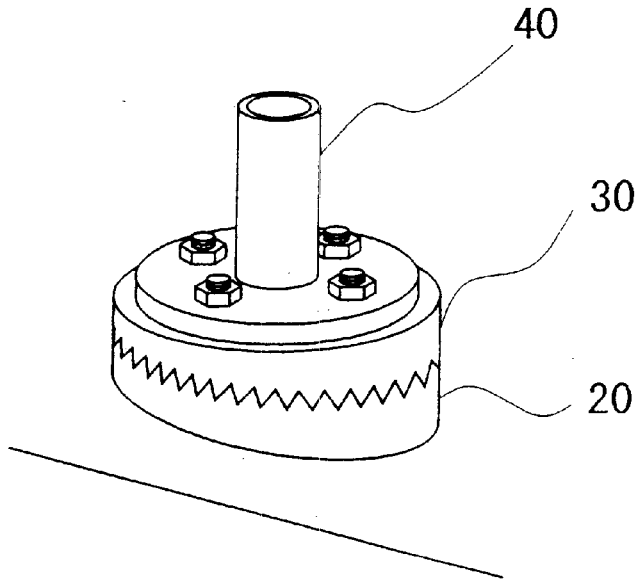
FIG. 5A is an exploded perspective view.
FIG. 5B is side sectional view of a third embodiment of a leveling assembly according to the present invention.
Figure 5B:
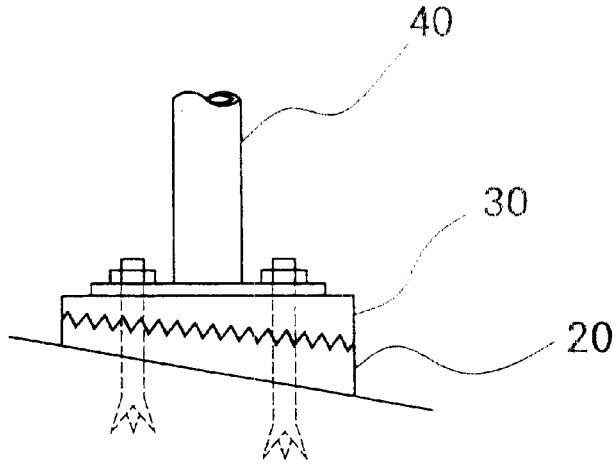

FIG. 5A is an exploded perspective view, and FIG. 5B is side sectional view of a third embodiment of a leveling assembly according to the present invention.

The third embodiment has a mesh (toothed) structure instead of the smooth second adjusting surface 22 and first adjusting surface 31 of FIG. 4.

The mesh structure has two differences between the first embodiment as previously explained. The first difference or an advantage is the work of temporarily holding the horizontal surface forming member 30 relative to the inclined surface setting member 20 becomes extremely easy. The second difference or disadvantage is that smaller adjustments than the mesh pitch cannot be made. In case the mentioned disadvantage does not present a big problem and the mentioned advantage can be used, the structure of the present embodiment may be adopted.

Although the first and the second embodiments are explained as dais for the slope fixing handrail pole 40, it may also be supplied properly as "zagane or metal washer" for building and house parts.

Moreover, in civil engineering, fixing the slope fixing handrail pole 40 is desired in some cases to a place where the finish of the slope is not completed even though the leveling of ground is finished. In such cases (not shown), installation by burying the setting surface of the inclined surface setting member into the ground is preferable. Even if burying into the ground does not set the pole vertically, the slope fixing handrail pole 40 can be vertically fixed relative to the horizontal surface forming member 30 by adjusting the first adjusting surface 31 relative to the second adjusting surface 22 while watching the spirit level 34.

In the present invention, the supplying of fewer parts lightens the burden on the parts supplier and at the same time lightens the burden on the worker and does not depend on the worker's skill.

Especially in the present invention, the supplying of the indexed and spirit level parts lightens the burden on the worker at adjusting work.

In the present invention the leveling assembly for setting a vertical prop is also useful for preventing bruises and cuts of the feet by the inclined surface setting member and/or the horizontal surface forming member and at the same time, the appearance is enhanced due to the cover structure.

What is claimed is:

1. A leveling assembly for setting a vertical prop comprised of an inclined surface setting member set on slope inclined surface and a horizontal surface forming member for fixing a vertical prop to be set vertically, wherein:

said horizontal surface forming member has an upper horizontal surface which is to be set in a horizontal position and a lower first adjusting surface formed by a planar surface not parallel to said horizontal surface, said inclined surface setting member has a lower setting surface which is to be set on the slope inclined surface and an upper second adjusting surface formed by a planar surface not parallel to said setting surface, and, said horizontal surface forming member and said inclined surface setting member are placed one on top of the other to make said first adjusting surface and said second adjusting surface facing to each other, and, said horizontal surface is adjusted to the horizontal position relative to the slope inclined surface by rotating said first adjusting surface and said second adjusting surface relative to each other and changing a degree angle between said horizontal surface and said setting surface.

2. A leveling assembly for setting a vertical prop mentioned in claim 1 being characterized in that graded indices for indicating a relative position of the members to each other is provided on a peripheral surface of said inclined surface setting member and a peripheral surface of said horizontal surface forming member.

3. A leveling assembly for setting a vertical prop mentioned in claim 1 being characterized in that a spirit level for confirming its adjustment to a horizontal position is provided on a surface of said horizontal surface forming member.

4. A leveling assembly for setting a vertical prop mentioned in claim 1 being characterized in that a base cover is provided around said inclined surface setting member and said horizontal surface forming member to cover them.

5. A leveling assembly for setting a vertical prop mentioned in claim 1 being characterized in that said inclined surface setting member and said horizontal surface forming member are formed by cutting them from a column member at an oblique angle not a right angle such that said first adjusting surface and said second adjusting surface are formed at a cutting surface therebetween.

6. A leveling assembly for setting a vertical prop mentioned in claim 1 being characterized in that said first adjusting surface and said second adjusting surface are meshed or toothed surfaces that facilitate holding the members in a holding position.

* * * * *